US008607701B2

(12) United States Patent
Greive et al.

(10) Patent No.: US 8,607,701 B2
(45) Date of Patent: Dec. 17, 2013

(54) DEVICE FOR FEEDING PRINTING PLATES TO A PLATE CYLINDER OF A PRINTING PRESS AND SHEET-FED ROTARY PRINTING PRESS HAVING THE DEVICE

(75) Inventors: Martin Greive, Schriesheim (DE); Alexander Knabe, Heidelberg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 642 days.

(21) Appl. No.: 12/254,352

(22) Filed: Oct. 20, 2008

(65) Prior Publication Data

US 2009/0101035 A1 Apr. 23, 2009

(30) Foreign Application Priority Data

Oct. 18, 2007 (DE) ..... 10 2007 049 920

(51) Int. Cl.
*B41F 27/12* (2006.01)
*B41F 5/00* (2006.01)

(52) U.S. Cl.
USPC ..... 101/477; 101/216

(58) Field of Classification Search
USPC ..... 101/382.1, 383, 415.1, 477, 216
See application file for complete search history.

(56) References Cited

U.S. PATENT DOCUMENTS

| | | | | |
|---|---|---|---|---|
| 5,111,744 | A | 5/1992 | Wieland | |
| 5,127,328 | A | 7/1992 | Wieland | |
| 5,440,988 | A * | 8/1995 | Ito | 101/477 |
| 5,555,812 | A | 9/1996 | Ruckmann et al. | |
| 5,575,212 | A * | 11/1996 | Moser et al. | 101/477 |
| 6,216,594 | B1 * | 4/2001 | Nakano et al. | 101/477 |
| 6,481,351 | B1 | 11/2002 | Edinger et al. | |
| 6,516,723 | B1 * | 2/2003 | Kundgen | 101/477 |
| 6,712,004 | B2 | 3/2004 | Sugiyama et al. | |
| 7,107,906 | B2 * | 9/2006 | Becker et al. | 101/477 |
| 7,363,858 | B2 * | 4/2008 | Edamitsu et al. | 101/477 |
| 2002/0066384 | A1 * | 6/2002 | Deshefi et al. | 101/477 |

FOREIGN PATENT DOCUMENTS

| | | | |
|---|---|---|---|
| DE | 3940795 | A1 | 6/1991 |
| DE | 4331430 | A1 | 3/1994 |
| DE | 10008489 | B4 | 9/2000 |
| EP | 1352740 | A2 | 10/2003 |
| JP | 3187748 | A | 8/1991 |
| JP | H08501037 | A | 2/1996 |
| JP | 2000280446 | A | 10/2000 |
| WO | 9406629 | A1 | 3/1994 |

OTHER PUBLICATIONS

German Office Action dated Apr. 29, 2008.

* cited by examiner

*Primary Examiner* — Ren Yan
(74) *Attorney, Agent, or Firm* — Laurence A. Greenberg; Werner H. Stemer; Ralph E. Locher

(57) ABSTRACT

A device for feeding printing plates to a plate cylinder in a printing press includes a pivotable guide element. The pivotable guide element has pivotable guide members which are in contact with an image side of the printing plate when the printing plate is being fed to the plate cylinder. These pivotable guide members are disposed in such a way that they can be disengaged from the printing plate when the printing plate is being wrapped around the plate cylinder. A sheet-fed rotary printing press having the device, is also provided.

6 Claims, 3 Drawing Sheets

DEVICE FOR FEEDING PRINTING PLATES TO A PLATE CYLINDER OF A PRINTING PRESS AND SHEET-FED ROTARY PRINTING PRESS HAVING THE DEVICE

CROSS-REFERENCE TO RELATED APPLICATION

This application claims the priority, under 35 U.S.C. §119, of German Patent Application DE 10 2007 049 920.7, filed Oct. 18, 2007; the prior application is herewith incorporated by reference in its entirety.

BACKGROUND OF THE INVENTION

Field of the Invention

The invention relates to a device for feeding printing plates to a plate cylinder of a printing press. The device includes a plate bending roller which is movably disposed and ensures that the leading edge of the printing plate is accurately inserted into a plate clamping device of the plate cylinder. The invention also relates to a sheet-fed rotary printing press having the device.

Such a device is already known from German Patent 100 08 489 B4, corresponding to U.S. Pat. No. 6,481,351.

A plate bending roller is provided for accurately feeding even used printing plates to the plate cylinder. The plate bending roller is positionable on a bend in the used printing plate for evening out the bend. In the process of doing so, the printing plate is held by suction cups on the image side of the printing plate.

SUMMARY OF THE INVENTION

It is accordingly an object of the invention to provide a device for feeding printing plates to a plate cylinder of a printing press and a sheet-fed rotary printing press having the device, which overcome the hereinafore-mentioned disadvantages of the heretofore-known devices of this general type and which provide an alternative plate feeding device that is removable from the image side of the printing plate when the plate is being wrapped around the plate cylinder.

With the foregoing and other objects in view, there is provided, in accordance with the invention, a device for feeding a printing plate having an image side, to a plate cylinder in a printing press. The device comprises a pivotable guide element having two cooperating transport rollers and a plate bending roller. One of the transport rollers is in contact with the image side of the printing plate. The one transport roller and the plate bending roller are pivotably disposed on the guide element.

In accordance with another feature of the invention, the device further includes an arm supported on the guide element for pivoting thereon. The one transport roller and the plate bending roller are disposed on the arm.

In accordance with a further feature of the invention, the plate bending roller is supported for rotation on the arm.

In accordance with an added feature of the invention, the device further includes at least one stop provided for pre-aligning the printing plate.

In accordance with an additional feature of the invention, the printing plate is a used printing plate having a bend formed therein, and the plate bending roller is spaced apart from the stop in such a manner that the plate bending roller acts on the bend formed in the used printing plate.

In accordance with yet another feature of the invention, the device is disposed on a cover for covering a cylinder and roller section of the printing press.

With the objects of the invention in view, there is also provided a sheet-fed rotary printing press having the device.

A particular advantage of the invention is that a part of the feeding device, in particular the part which is in contact with the image side of the printing plate, is pivotable away and removable from the printing plate once the leading edge of the printing plate has been clamped by the clamping device of the plate cylinder. Consequently, scratching of the printing plate in the region of the image is avoided.

Other features which are considered as characteristic for the invention are set forth in the appended claims.

Although the invention is illustrated and described herein as embodied in a device for feeding printing plates to a plate cylinder of a printing press and a sheet-fed rotary printing press having the device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
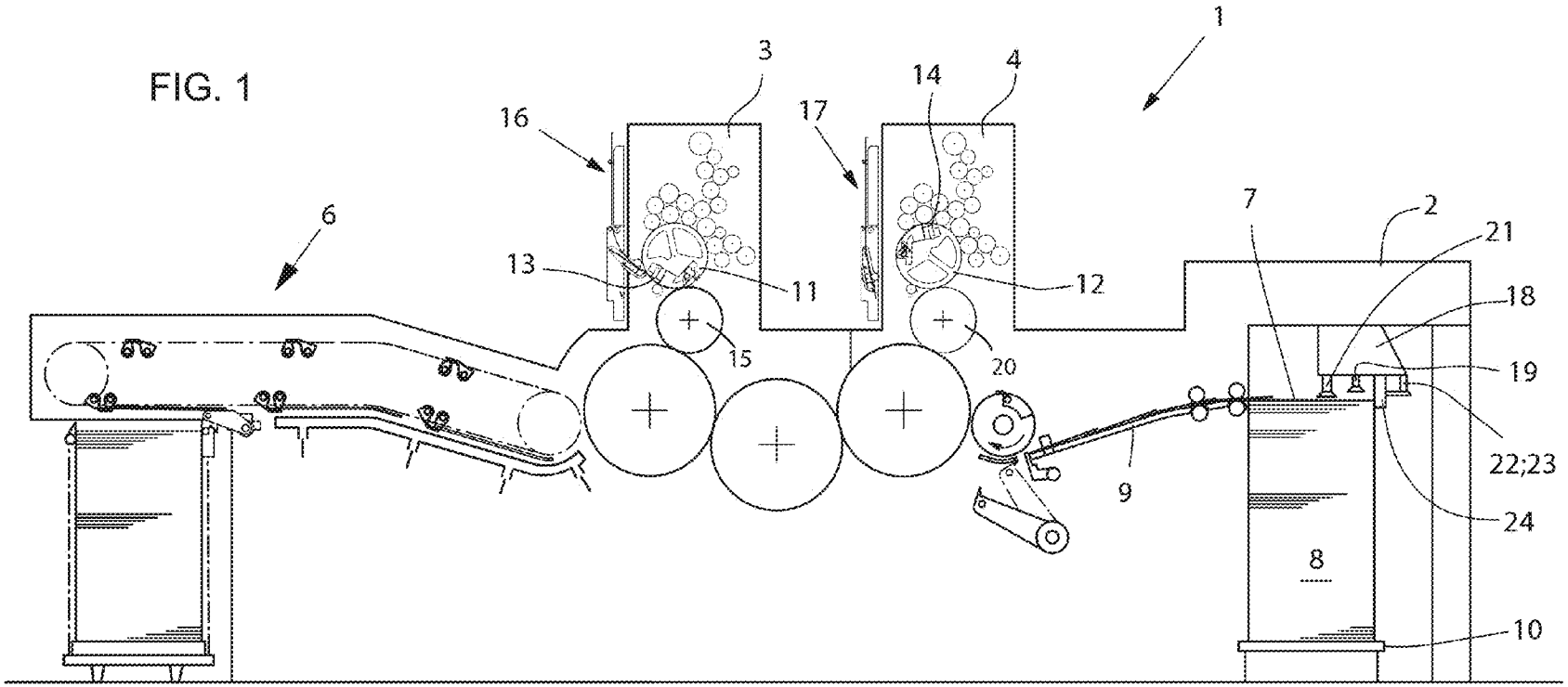
FIG. 1 is a diagrammatic, longitudinal-sectional view of a sheet-fed rotary printing press.

Referring now to the figures of the drawings in detail and first, particularly, to FIG. 1 thereof, there is seen a machine for processing sheets 7, for example a printing press 1, which includes a feeder 2, at least one printing unit 3, 4, and a delivery 6. The sheets 7 are taken from a stack 8 of sheets and are fed to the printing units 3 and 4 over a feed table 9, individually or in shingled formation. As is known in the art, each of the printing units 3, 4 includes a plate cylinder 11, 12 and a blanket cylinder 15, 20 interacting with the respective plate cylinder 11, 12. Each of the plate cylinders 11, 12 has a clamping device 13, 14 for clamping flexible printing plates. Moreover, a device 16, 17 for semiautomatic or fully automatic plate changing is associated with each respective plate cylinder 11, 12.

The stack 8 of sheets rests on a stack plate 10 which can be lifted in a controlled manner. The sheets 7 are removed from the top of the sheet stack 8 through the use of a so-called suction head 18 which includes, among other elements, a number of lifting and dragging suckers 19, 21 for separating the sheets 7. Moreover, blowers 22 are provided to loosen the upper layers of sheets. Sensing elements 23 control the lifting of the stack of sheets. A number of lateral and rear stops 24 are provided to align the sheet stack 8, in particular the upper sheets 7 in the stack 8.

Figure 2:
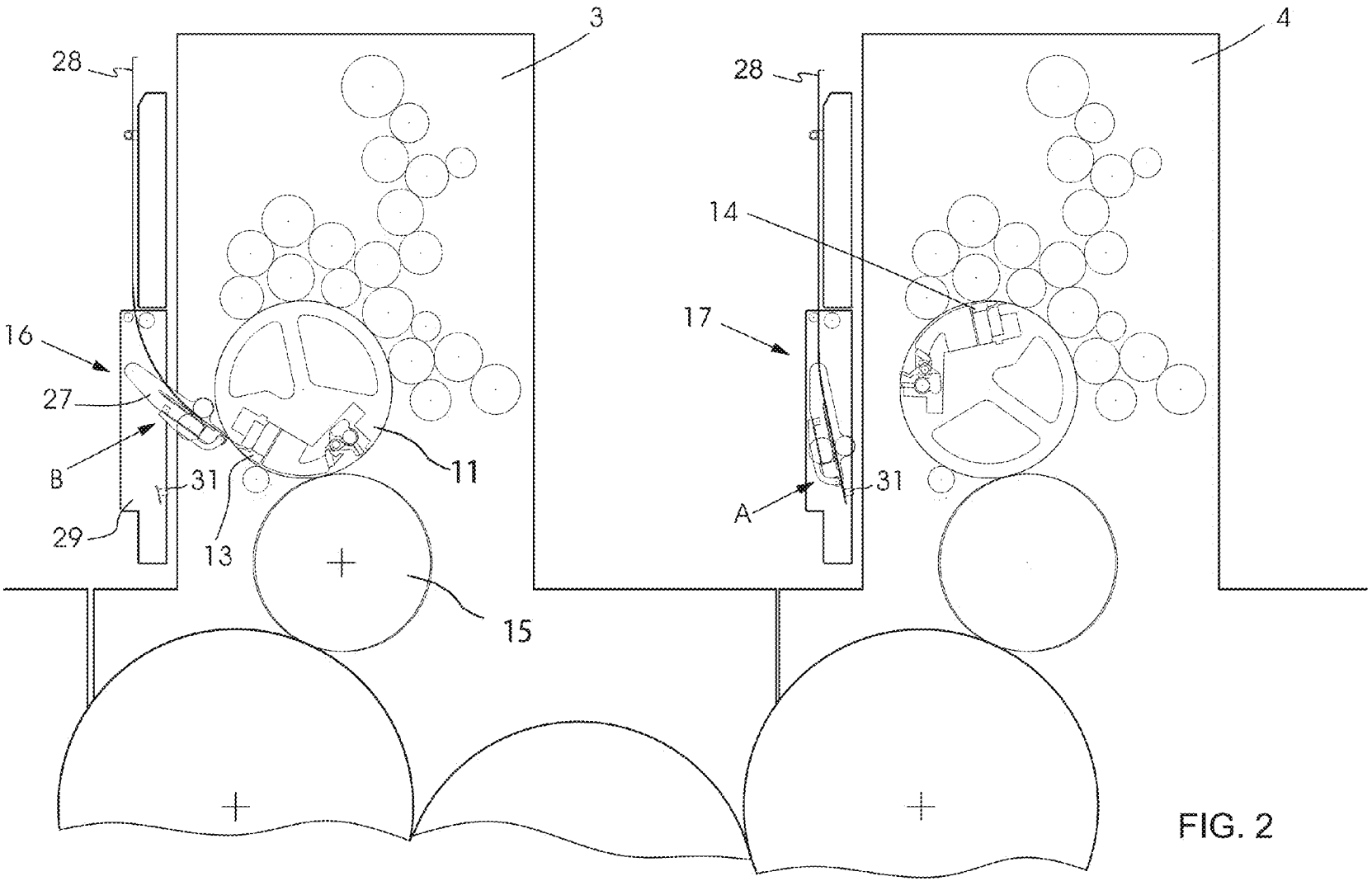
FIG. 2 is an enlarged, fragmentary, longitudinal-sectional view of a plate feeding device in an operating position and a plate receiving position.
Figure 3:
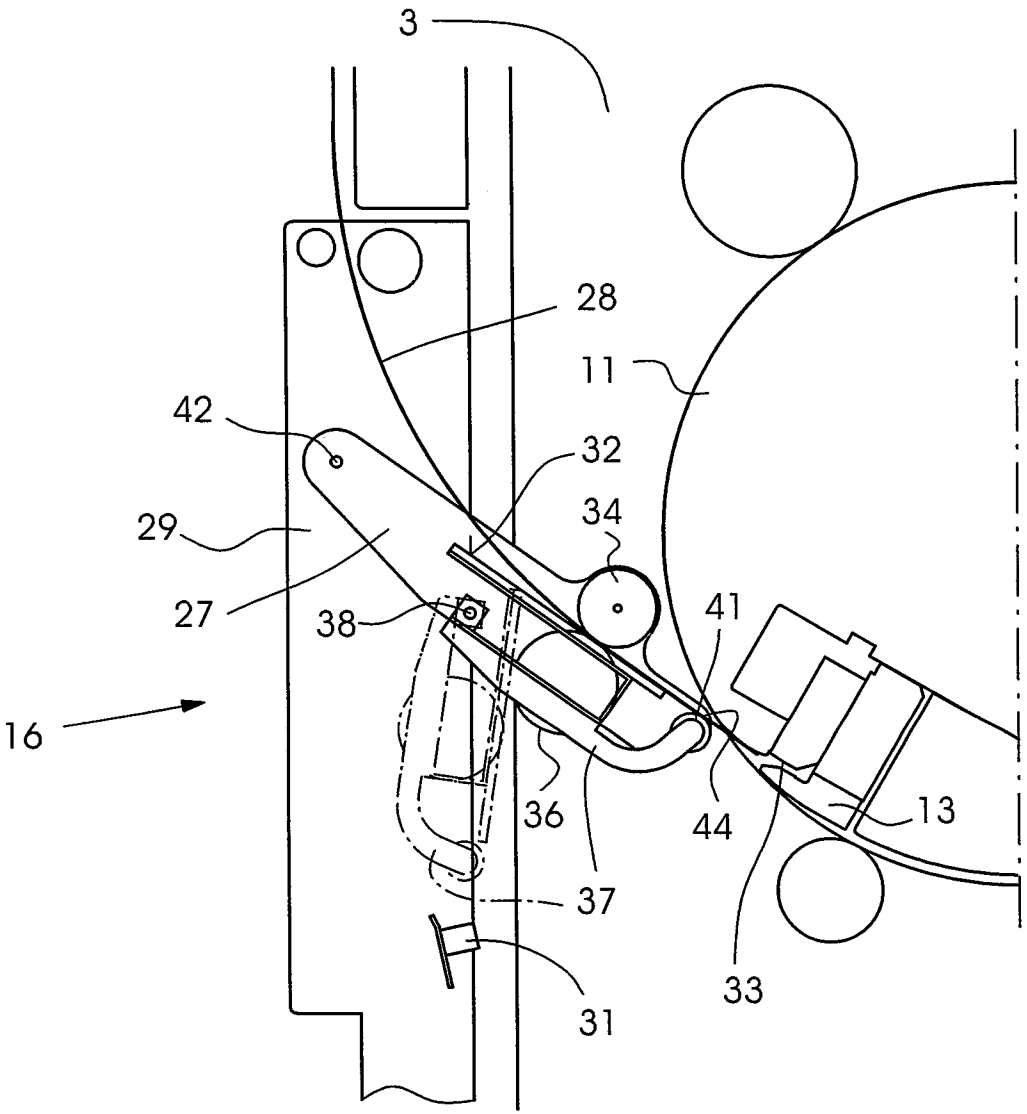
FIG. 3 is a further enlarged, fragmentary, longitudinal-sectional view of the plate feeding device in the operating position.

The devices 16, 17 have an identical construction. Therefore, only the device 16 will be described by way of example. It is seen from FIG. 2 that the device 16 includes a guide element 27 for a printing plate 28. The guide element 27 is disposed to pivot on a cover 29, which covers a cylinder and roller section upstream of the printing unit 3. The guide element 27 can be pivoted from a receiving position A in which a printing plate 28 is received and pre-aligned through the use of a stop 31, into an operating position B in which the printing plate 28 is fed to the plate cylinder 11. The guide element 27 has a guide plane 32 seen in FIG. 3. In the operating position B, the guide plane 32 forms an extension of a plate clamping pad 33 of the clamping device 13 of the plate cylinder 11 and is disposed to pivot on a lever 37 on the guide element 27. Furthermore, two transport rollers 34, 36 are disposed on the guide element 27. The transport rollers 34, 36 are in operating contact to transport the printing plate 28 and to fix it in the receiving position A. The transport roller 34, which is in contact with the back side of the printing plate 28, is disposed directly on the guide element 27. The transport roller 36, which is in contact with the imaged front side of the printing plate, is supported on the pivotable lever 37. A plate bending roller 41 is supported to rotate on an end facing away from a bearing location 38 of the lever 37. In the operating position B, the plate bending roller 41 is located between an end of the guide surface 32 and the plate clamping pad 33. The plate bending roller 41 exerts pressure on a defined location on the printing plate 28. This defined location corresponds to a bend 44 which a used printing plate has when it is being reused. This bend 44 is produced as the plate moves from the clamping device 13 to the periphery or circumference of the plate cylinder 11.

In order to feed a new or used printing plate 28 to the plate cylinder 11, the printing plate 28 is initially pre-aligned in the receiving position A at the stop 31. Then the guide element 27 pivots about its bearing location 42 into the operating position B for the plate feeding operation. If necessary, the plate bending roller 41 then exerts pressure on the bend 44 of the used printing plate 28. The plate bending roller 41 is then pivoted in the direction of the plate cylinder 11 far enough for the leading edge of the plate to be aligned in parallel with the plate clamping pad 33. As soon as the leading edge of the plate is parallel with the clamping pad 33, the transport rollers 34, 36 move the printing plate 28 into the clamping device 13. Once the printing plate 28 has been engaged and clamped, the lever 37 is pivoted away together with the plate bending roller 41, the guide plane 32, and the transport roller 36.

Thus, the printing plate 28 can be wrapped around the plate cylinder 11 by rotating the latter without any guide elements being in contact with the image side of the printing plate 28.

The pivoting movements of the guide element 27 and the lever 37 are implemented through the use of non-illustrated, remote-controllable actuators, which are preferably controlled automatically.

The invention claimed is:

1. A device for feeding a used printing plate having a bend, an image side and a back side, to a plate cylinder in a printing press, the device comprising:

at least one stop for pre-aligning the printing plate;

a pivotable guide element having two cooperating transport rollers and a plate bending roller, said plate bending roller being spaced apart from said stop to cause said plate bending roller to act on the bend formed in the used printing plate;

one of said transport rollers being in contact with the image side of the printing plate;

the other of said transport rollers being stationary on said guide element, driven and in contact with the back side of the printing plate;

said one transport roller and said plate bending roller being freely rotatable and pivotably disposed on said guide element; and a common arm pivotably supported on said guide element, said one transport roller and said plate bending roller being disposed on said common arm.

2. The device according to claim 1, wherein said plate bending roller is supported for rotation on said common arm.

3. The device according to claim 1, which further comprises a cover covering a cylinder and roller section of the printing press, said guide element being disposed on said cover.

4. A sheet-fed rotary printing press, comprising a device according to claim 1.

5. The device according to claim 1, wherein said one transport roller and said plate bending roller each have two ends, and said common arm is one of two single arms each disposed at a respective end of said one transport roller and at a respective end of said plate bending roller.

6. The device according to claim 1, wherein said plate bending roller is configured to exert pressure on the bend in the used printing plate to permit the used printing plate to be subsequently clamped onto said plate cylinder.

* * * * *